US011479040B2

(12) United States Patent
Katayama et al.

(10) Patent No.: US 11,479,040 B2
(45) Date of Patent: Oct. 25, 2022

(54) LIQUID DISCHARGING HEAD

(71) Applicant: Brother Kogyo Kabushiki Kaisha, Nagoya (JP)

(72) Inventors: Hiroshi Katayama, Toyoake (JP); Shotaro Kanzaki, Handa (JP); Jiro Yamamoto, Nagoya (JP); Keita Sugiura, Toyokawa (JP); Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/345,016

(22) Filed: Jun. 11, 2021

(65) Prior Publication Data

US 2021/0402775 A1 Dec. 30, 2021

(30) Foreign Application Priority Data

Jun. 29, 2020 (JP) ..... JP2020-111245

(51) Int. Cl.
*B41J 2/14* (2006.01)
*B41J 2/155* (2006.01)
*B41J 2/18* (2006.01)

(52) U.S. Cl.
CPC ..... *B41J 2/14201* (2013.01); *B41J 2/155* (2013.01); *B41J 2/18* (2013.01);
(Continued)

(58) Field of Classification Search
CPC . B41J 2/18; B41J 2/14233; B41J 2/155; B41J 2/14201; B41J 2/175; B41J 2202/21;
(Continued)

(56) References Cited

U.S. PATENT DOCUMENTS 8,403,465 B2 3/2013 Von Essen et al.
10,549,539 B2 * 2/2020 Katayama ..... B41J 11/007
(Continued)

FOREIGN PATENT DOCUMENTS

JP 2010-241120 A 10/2010

*Primary Examiner* — An H Do
(74) *Attorney, Agent, or Firm* — Banner & Witcoff, Ltd.

(57) ABSTRACT

A liquid discharging head includes: individual channels; a first common channel; and a second common channel Each of the plurality of individual channels includes: a pressure chamber, a nozzle, a connecting channel, a first communicating channel, and two second communicating channels. A first vector of the first communicating channel has an orientation from one end to the other end of the first communicating channel. Respective second vectors of the two second communicating channels have orientations, each of the orientations being from one end to the other end of one of the two second communicating channels along an extending direction of the two second communicating channels. The first communicating channel is arranged, with respect to the nozzle, on one side in a second direction orthogonal to the first direction, and the two second communicating channels are arranged, with respect to the nozzle, on the other side in the second direction. Each of the orientation of the first vector and the orientation of the second vector includes an orientation component from the one side toward the other side in the second direction.

17 Claims, 8 Drawing Sheets

(52) U.S. Cl.
CPC .. *B41J 2002/14459* (2013.01); *B41J 2202/11* (2013.01); *B41J 2202/12* (2013.01)

(58) Field of Classification Search
CPC ..... B41J 2202/11; B41J 2002/14419; B41J 2202/12; B41J 2002/14459; B41J 2002/14306
See application file for complete search history.

(56) References Cited

U.S. PATENT DOCUMENTS

| | | | | |
|---|---|---|---|---|
| 10,792,921 | B2 * | 10/2020 | Sugiura | B41J 2/1433 |
| 10,814,625 | B2 * | 10/2020 | Yazaki | B41J 2/04568 |
| 11,141,982 | B2 * | 10/2021 | Mizuno | B41J 2/26 |
| 2010/0214380 | A1 | 8/2010 | Essen et al. | |

* cited by examiner

LIQUID DISCHARGING HEAD

CROSS REFERENCE TO RELATED APPLICATION

The present application claims priority from Japanese Patent Application No. 2020-111245, filed on Jun. 29, 2020, the disclosure of which is incorporated herein by reference in its entirety.

BACKGROUND

Field of the Invention

The present disclosure relates to a liquid discharging head provided with a plurality of individual channels, a first common channel and a second common channel.

Description of the Related Art

Japanese Patent Application Laid-Open No. 2010-241120 corresponding to United States Patent Application Publication No. US2010/0214380 discloses a liquid circulating system provided with a plurality of channels (individual channels) which connect to nozzles, respectively; and a liquid inlet passage (first common channel) and a recirculating channel (second common channel) which communicate with the plurality of channels. Each of the plurality of channels includes a pump chamber (pressure chamber) connecting to each of the nozzles, a descending part (connecting channel) connecting the pump chamber and each of the nozzles, a pump-chamber inlet passage (first communicating channel) communicating the liquid inlet passage and the pump chamber, and a recirculating passage (second circulating channel) communicating the descending part and the recirculating channel A liquid inside the liquid inlet passage is supplied to the pump chamber via the pump-chamber inlet passage of each of the plurality of channels, passes the descending part from the pump chamber; a part of the liquid flows to each of the nozzles, and the remaining part of the liquid flows in the recirculating passage and flows into the recirculating channel.

In Japanese Patent Application Laid-Open No. 2010-241120 corresponding to United States Patent Application Publication No. US2010/0214380, one recirculating passage (second communicating channel) is provided with respect to each of the nozzles. In this configuration, in a case that the liquid is circulated during recording, any skewered flow (biased flow) of the liquid directed to the one recirculating channel (second communicating channel) is generated in the vicinity of each of the nozzles, and a direction in which the liquid is discharged or ejected from each of the nozzles is deviated from a desired direction.

An object of the present disclosure is to provide a liquid discharging head capable of suppressing the occurrence of a problem that the discharging direction (ejecting direction) is deviated from the desired direction.

SUMMARY

According to an aspect of the present disclosure, there is provided a liquid discharging head including:

a plurality of individual channels;

at least one first common channel communicating with the plurality of individual channels; and at least one second common channel communicating with the plurality of individual channels, wherein each of the plurality of individual channels includes:

a pressure chamber, a nozzle which is apart from the pressure chamber in a first direction, a connecting channel connecting the pressure chamber and the nozzle, a first communicating channel which has one end connected to the at least one first common channel and the other end connected to the pressure chamber, and two second communicating channels each of which has one end connected to the connecting channel and the other end connected to the at least one second common channel, and which are parallel to each other;

in each of the plurality of individual channels, a first vector has an orientation from the one end to the other end of the first communicating channel along an extending direction of the first communicating channel;

a second vector has an orientation from the one end to the other end of each of the two second communicating channels along an extending direction of the two second communicating channels;

the first communicating channel is arranged, with respect to the nozzle, on one side in a second direction orthogonal to the first direction, and the two second communicating channels are arranged, with respect to the nozzle, on the other side in the second direction; and each of the orientation of the first vector and the orientation of the second vector includes an orientation component from the one side toward the other side in the second direction.

DESCRIPTION OF THE EMBODIMENTS

First Embodiment

Figure 1:
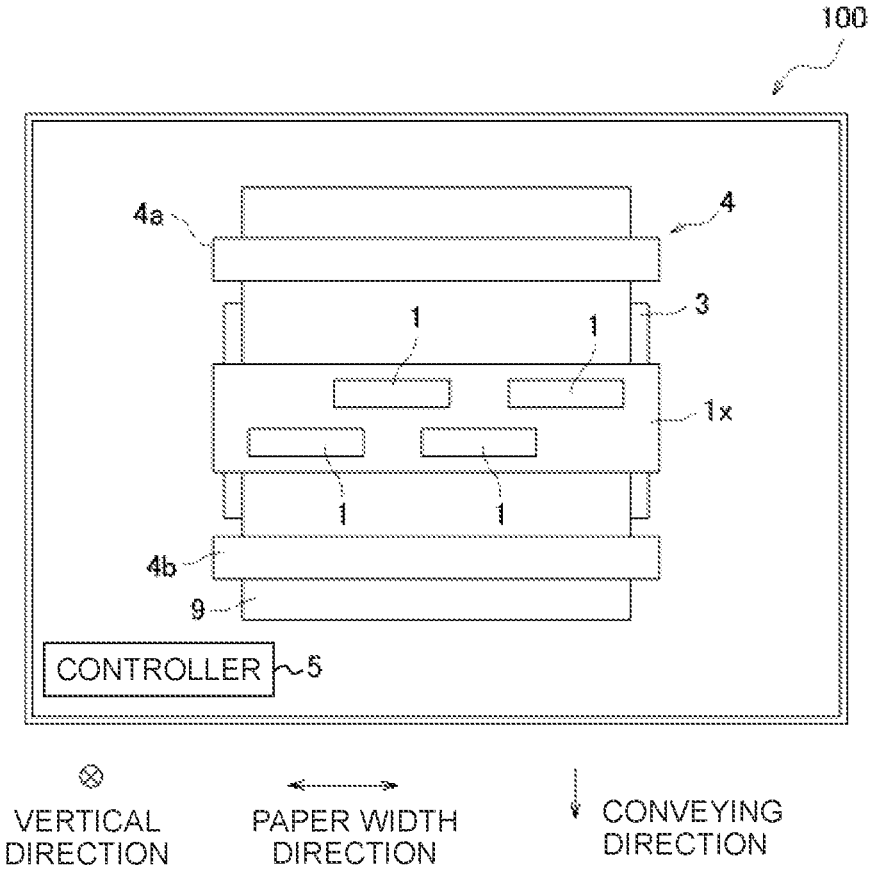
FIG. 1 is a plan view of a printer provided with a head according to a first embodiment of the present disclosure.

Firstly, an explanation will be given about the overall configuration of a printer 100 provided with a head 1 according to a first embodiment of the present disclosure, with reference to FIG. 1.

The printer 100 is provided with a head unit 1*x* including four pieces of the head 1, a platen 3, a conveying mechanism 4 and a controller 5.

Paper sheet (paper) 9 is placed on the upper surface of the platen 3.

The conveying mechanism 4 has two roller pairs 4*a* and 4*b* which are arranged, with the platen 3 being arranged or interposed therebetween in a conveying direction (a direction which is orthogonal to the vertical direction). In a case that a conveying motor (not depicted in the drawings) is driven by control of the controller 5, the two roller pairs 4*a* and 4*b* rotate in a state that the paper 9 is held (pinched) therebetween, thereby conveying the paper 9 in the conveying direction.

The head unit 1*x* is elongated in a paper width direction (a direction which is orthogonal to both of the conveying direction and the vertical direction) and is of a line system in which an ink is ejected or discharged from a nozzle 21 (see FIGS. 2 to 4) with respect to the paper 9 in a state that the position of the head unit 1*x* is fixed. Each of the four heads 1 is long in the paper width direction and the four heads 1 are arranged in a staggered manner in the paper width direction.

The controller 5 includes a ROM (Read Only Memory), a RAM (Random Access Memory) and an ASIC (Application Specific Integrated Circuit). The ASIC executes a recording processing, etc., in accordance with a program stored in the ROM. In the recording processing, the controller 5 controls a driver IC and a conveying motor (both of which are not depicted in the drawings) of each of the heads 1 based on a recording instruction (including image data) inputted from an external apparatus such as a PC, etc., and records an image on the paper 9.

Next, the configuration of each of the heads 1 will be explained, with reference to FIGS. 2 to 4.

Figure 4:
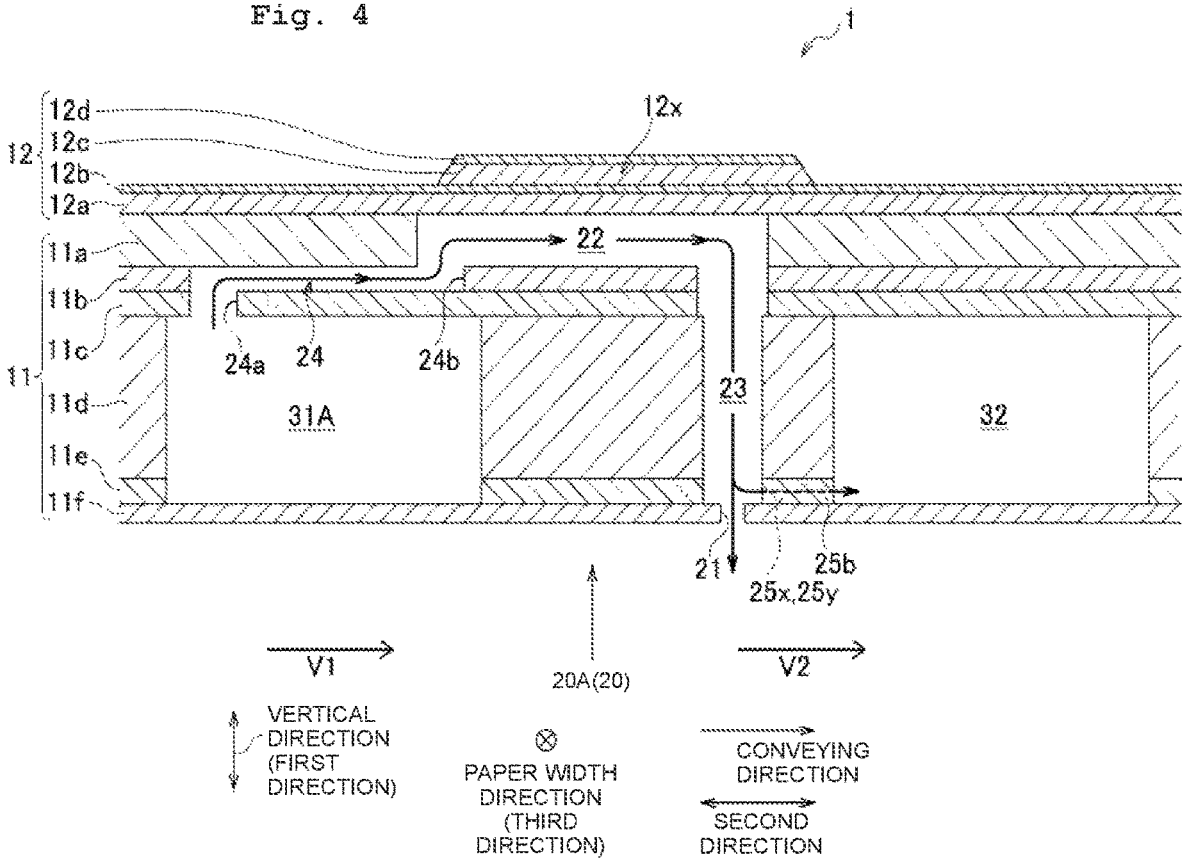
FIG. 4 is a cross-sectional view of the head along a line IV-IV in FIG. 2.

As depicted in FIG. 4, the head 1 has a channel member 11 and an actuator member 12.

The channel member 11 is constructed of six plates 11*a* to 11*f* which are stack on one another in the vertical direction (first direction) and which are joined to one another. A through hole forming a channel is formed in each of the plates 11*a* to 11*f*.

The channel includes a plurality of individual channels 20, two supply channels 31A and 31B and one return channel 32 each of which communicates with the plurality of individual channels 20. The supply channels 31A and 32B correspond to a "first common channel" of the present disclosure, and the return channel 32 corresponds to a "second common channel" of the present disclosure.

Figure 2:
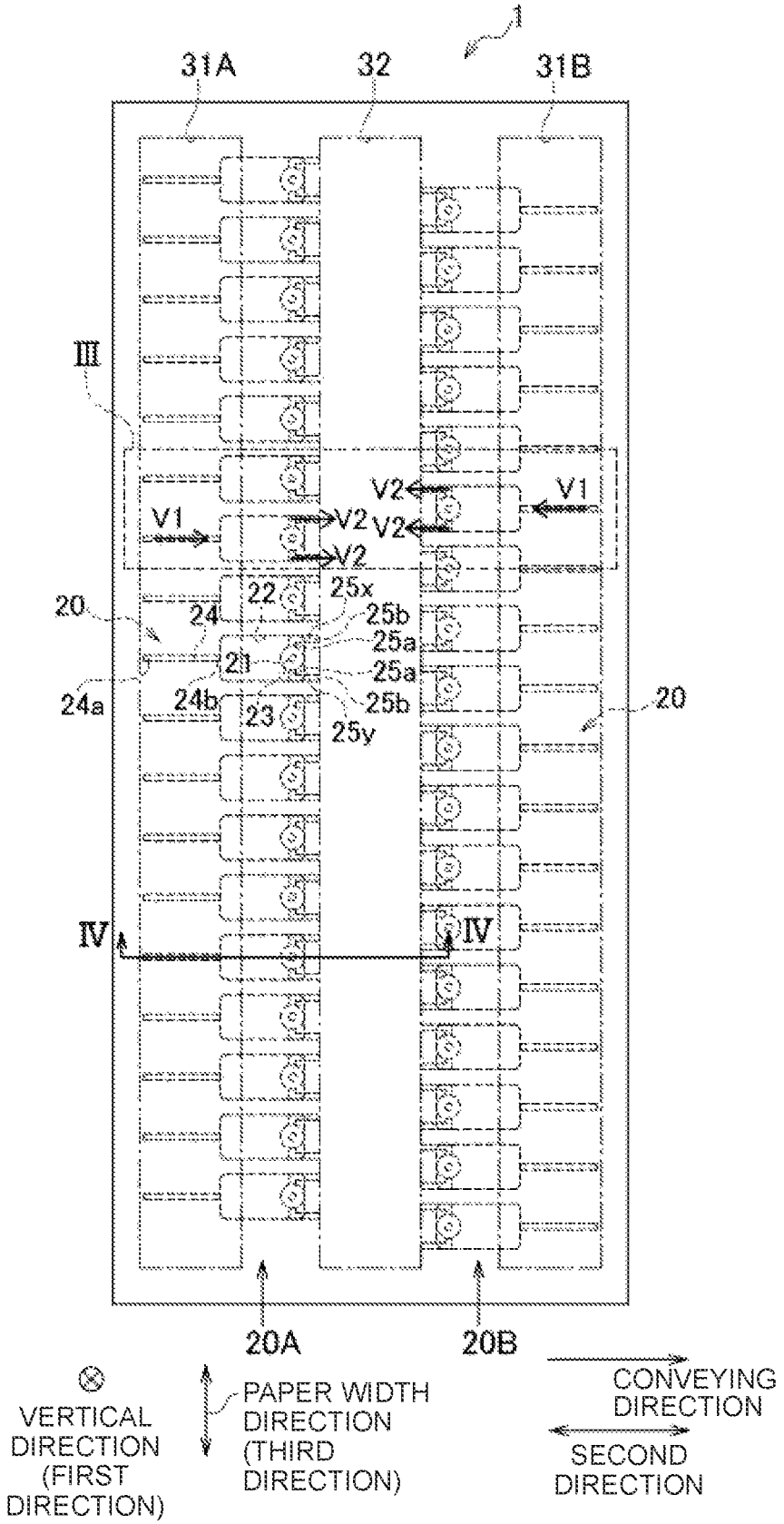
FIG. 2 is a plan view of the head.

As depicted in FIG. 2, the supply channels 31A and 31B and the return channel 32 arranged side by side in a direction parallel to the conveying direction (second direction). In the conveying direction, the return channel 32 is arranged between the supply channels 31A and 32B. Each of the supply channels 31A and 31B and the return channel 32 extends in the paper width direction (third direction). A side surface of each of the supply channels 31A and 31B and the return channel 32 has a shape of a flat surface along the paper width direction (in other words, has no concavities and convexities).

As depicted in FIG. 2, the plurality of individual channels 20 are arranged in a staggered manner in the paper width direction so as to construct a first individual channel array 20A and a second individual channel array 20B. The first individual channel array 20A and the second individual channel array 20B are arranged side by side in the conveying direction. Each of the first and second individual channel arrays 20A and 20B is constructed of individual channels 20 arranged side by side in the paper width direction. The individual channels 20 constructing the first individual channel array 20A communicate with the supply channel 31A and the return channel 32. The individual channels 20 constructing the second individual channel array 20B communicate with the supply channel 31B and the return channel 32. Namely, the return channel 32 communicates with both of the individual channels 20 constructing the first individual channel array 20A and the individual channels 20 constructing the second individual channel array 20B.

As depicted in FIG. 4, each of the plurality of individual channels 20 includes: a pressure chamber 22, a nozzle 21 which is apart from the pressure chamber 22 in the vertical direction, a connecting channel 23 connecting the pressure chamber 22 and the nozzle 21, an inflow channel 24 communicating the pressure chamber 22 and the supply channel 31A or 31B corresponding thereto, and two outflow channels 25*x* and 25*y* communicating the connecting channel 23 and the return channel 32. The inflow channel 24 corresponds to a "first communicating channel" of the present disclosure, and each of the outflow channels 25*x* and 25*y* corresponds to a "second communicating channel" of the present disclosure.

The nozzle 21 is constructed of a through hole formed in the plate 11*f*, and is opened in the lower surface of the channel member 11.

The pressure chamber 22 is constructed of a through hole formed in the plate 11*a*, and is opened in the upper surface of the channel member 11. The connecting channel 23 is connected to one end in the conveyance direction of the pressure chamber 22, and the inflow channel 24 is connected to the other end in the conveyance direction of the pressure chamber 22. The other end in the conveying direction of the pressure chamber 22 overlaps, in the vertical direction, with the supply channel 31A or 31B corresponding thereto; and the pressure chamber 22 does not overlap with the return channel 32 in the vertical direction.

The connecting channel 23 is a channel having a cylindrical shape and extending downward from the pressure chamber 22, and is constructed of through holes each of which is formed in one of the plates 11*b* to 11*e*. The nozzle 21 is arranged at a location immediately below the connecting channel 23.

The inflow channel 24 is constructed of through holes each of which is formed in one of the plates 11*b* and 11*c*, and has one end 24*a* communicating with the supply channel 31A or 31B corresponding thereto and the other end 24*b* communicating with the pressure chamber 22. The one end 24*a* connects to the upper surface of the supply channel 31A or 31B corresponding thereto. The other end 24*b* connects to the lower surface of the pressure chamber 22.

Each of the outflow channels 25*x*, 25*y* is constructed of a through hole formed in the plate 11*e*, and has one end 25*a* (see FIG. 3) communicating with the connecting channel 23 and the other end 25*b* communicating with the return channel 32. The one end 25*a* connects to a side surface of the connecting channel 23. The other end 25*b* connects to a side surface of the return channel 32.

Figure 3:
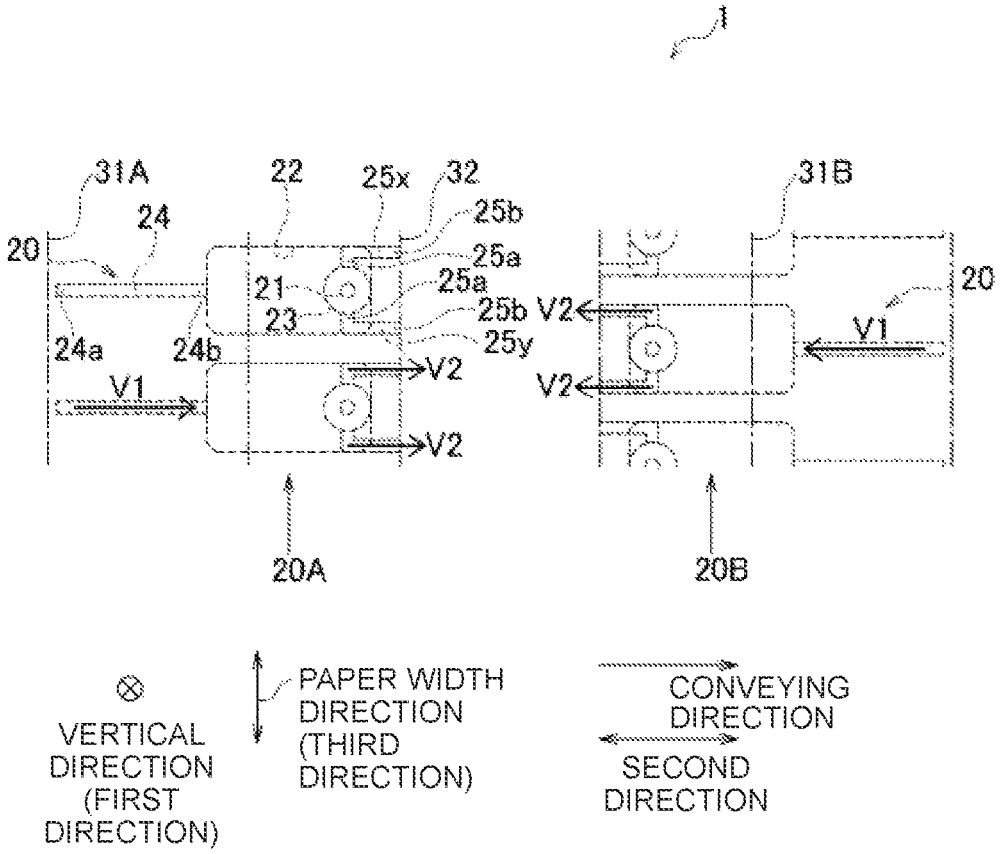
FIG. 3 is an enlarged view of an area III depicted in FIG. 2.

As depicted in FIG. 3, each of the inflow channel 24 and the outflow channels 25*x*, 25*y* has a width (length in the paper width direction) which is smaller than a width (length in the paper width direction) of the pressure chamber 22, and functions as a throttle.

Further, as depicted in FIG. 3, in each of the individual channels 20, the inflow channel 24 is arranged on one side in the conveying direction with respect to the nozzle 21, and the two outflow channels 25*x* and 25*y* are arranged on the other side in the conveying direction with respect to the nozzle 21.

The inflow channel 24 and the outflow channels 25*x* and 25*y* are parallel to each other, and each extend in the conveying direction. Note that, strictly speaking, each of the outflow channels 25*x* and 25*y* has a shape of letter "L", and a part, of each of the outflow channels 25*x* and 25*y*, in the vicinity of the one end 25*a* extends in the paper width direction. The length of this part, however, of each of the outflow channels 25*x* and 25*y*, relative to the entirety of each of the outflow channels 25*x* and 25*y* is minute. Thus, there is little effect by this part to the flow of the ink in the each of the outflow channels 25*x* and 25*y*. Similarly, the inflow channel 24 has a shape of letter "L", and a part, of the inflow channel 24, in the vicinity of the one end 24*a* extends in the vertical direction. The length of this part, however, of the inflow channel 24 relative to the entirety of the inflow channel 24 is minute. Thus, there is little effect by this part to the flow of the ink in the inflow channel 24.

Here, in each of the plurality of individual channels 20, a first vector V1 and second vector V2 are defined as follows.

First vector V1: a vector having an orientation from the one end 24*a* toward the other end 24*b* of the inflow channel 24, along an extending direction of the inflow channel 24.

Second vector V2: vector having an orientation from the one end 25*a* toward the other end 25*b* of each of the outflow channels 25*x* and 25*y*, along an extending direction of the outflow channels 25*x* and 25*y*.

As described above, although, strictly speaking, each of the inflow channel 24 and the outflow channels 25*x* and 25*y* has the shape of letter "L", the extending direction of the part which is linear and longest in each of the inflow channel 24 and the outflow channels 25*x* and 25*y* is defined as the extending direction of the each of the inflow channel 24 and the outflow channels 25*x* and 25*y*. In the present embodiment, the extending direction of the outflow channel 25*x* and the extending direction of the outflow channel 25*y* are a same direction (second direction). In the inflow channel 24, the ink (liquid) flows in the orientation of the first vector V1. In the respective outflow channels 25*x* and 25*y*, the ink (liquid) flows in the orientation of the second vector V2.

In each of the plurality of individual channels 20, the first vector V1 and the second vector V2 are parallel to each other. Each of the orientation of the first vector V1 and the orientation of the second vector V2 includes a component of a same orientation (a component of an orientation from the one side toward the other side in the conveying direction, namely a component of an orientation, with respect to the nozzle 21, from a side at which the inflow channel 24 is arranged toward a side at which the outflow channels 25*x* and 25*y* are arranged). In the present embodiment, the orientation of the first vector V1 and the orientation of the second vector V2 are a same orientation in each of the individual channels 20. The orientation of the first vector V1 of each of the individual channels 20 in the first individual channel array 20A and the orientation of the first vector V1 of each of the individual channels 20 in the second individual channel array 20B are opposite to each other. The orientation of the second vector V2 of each of the individual channels 20 in the first individual channel array 20A and the orientation of the second vector V2 of each of the individual channels 20 in the second individual channel array 20B are opposite to each other. Note, however that in FIGS. 2, 3 and 4, arrows V1 indicate the orientation of the first vector V1, and arrows V2 indicate the orientation of the second vector V2. Both the arrows V1 and V2 do not indicate the respective magnitudes of the first vector V1 and the second vector V2. Similarly, in FIG. 8 (to be described later on), although an arrow V2 indicates the orientation of the second vector V2, and an arrow V3 indicates the orientation of third vector V3, both the arrows V2 and V3 do not indicate the respective magnitudes of the second vector V2 and the third vector V3.

The one end 25*a* of the outflow channel 25*x* is located at one side in the paper width direction with respect to the nozzle 21, and the one end 25*a* of the outflow channel 25*y* is located at the other side in the paper width direction with respect to the nozzle 21. The one ends 25*a* of the two outflow channels 25*x* and 25*y* are arranged symmetrically with respect to the nozzle 21.

The outflow channels 25*x* and 25*y* are within the area of the pressure chamber 22 in the paper width direction. Namely, each of the outflow channels 25*x* and 25*y* entirely overlaps with the pressure chamber 22 in the conveying direction, and does not include any part thereof which does not overlap with the pressure chamber 22 in the conveying direction. The outflow channel 25*x* is located at the one end in the paper width direction of the pressure chamber 22. The outflow channel 25*y* is located at the other end in the paper width direction of the pressure chamber 22.

The other ends 25*b* of the outflow channels 25*x* and 25*y* in the first individual channel array 20A and the other ends 25*b* of the outflow channels 25*x* and 25*y* in the second individual channel array 20B do not overlap with each other in the conveying direction.

Each of the supply channels 31A and 31B and the return channel 32 communicates with a sub tank (not depicted in the drawings). The sub tank communicates with a main tank which stores the ink, and stores the ink supplied from the main tank.

In a case that a pump (not depicted in the drawings) is driven by control of the controller 5, the ink inside the sub tank flows into the supply channels 31A and 31B. The ink inflowed into the supply channel 31A is suppled to each of the individual channels 20 in the first individual channel array 20A, while moving inside the supply channel 31A in the paper width direction. The ink inflowed into the supply channel 31B is suppled to each of the individual channels 20 in the second individual channel array 20B, while moving inside the supply channel 31B in the paper width direction.

The ink supplied to each of the individual channels 20 from one of the supply channel 31A and 31B flows through the inflow channel 24 and flows into the pressure chamber 22, flows inside the pressure chamber 22 in a substantially horizontal manner, and flows into the connecting channel 23, as depicted in FIG. 4. This ink moves downward while passing through the connecting channel 23; a part of the ink is ejected or discharged from the nozzle 21, and a remaining part of the ink flows through the two outflow channels 25*x* and 25*y* and flows out to the return channel 32 (see FIG. 3).

The ink flows into the return channel 32 from each of the individual channels 20 of the first individual channel array 20A and from each of the individual channels 20 of the second individual channel array 20B. The return channel 32 is arranged, in the conveying direction, between the connecting channels 23 of the first individual channel array 20A and the connecting channels 23 of the second individual channel array 20B, and the ink flows into the return channel 32 from both sides in the conveying direction with respect to the return channel 32. This ink flows through the return channel 32 and is returned to the sub tank.

By circulating the ink between the sub tank and the channel member 11 in such a manner, it is possible to realize discharge or exhaust of an air bubble and/or prevention of increase in the viscosity of the ink, in the supply channels 31A and 31B, the return channel 32, and further in each of the individual channels 20, which are formed in the channel member 11. Further, in a case that the ink contains a component which sediments or precipitates (a component of which sedimentation or precipitation might occur; a pigment, etc.), such a component is agitated and the sedimentation (precipitation) of the component is prevented.

As depicted in FIG. 4, the actuator member 12 includes a vibration plate 12, a common electrode 12*b*, a plurality of piezoelectric bodies 12*c*, and a plurality of individual electrodes 12*d*, in this order from a lower part thereof.

The vibration plate 12*a* and the common electrode 12*b* are arranged on the upper surface of the channel member 11 (upper surface of the plate 11*a*), and cover all the plurality of pressure chambers 22 formed in the upper surface of the plate 11*a*. On the other hand, each of the plurality of piezoelectric bodies 12*c* and each of the plurality of individual electrodes 12*d* are provided on one of the plurality of pressure chambers 22, and overlap with one of the plurality of pressure chambers 22 in the vertical direction.

The common electrode 12*b* and the plurality of individual electrodes 12*d* are electrically connected to the driver IC (not depicted in the drawings). The driver IC changes the potential of each of the plurality of individual electrodes 12*d*, while maintaining the potential of the common electrode 12*b* to the ground potential. Specifically, the driver IC generates a driving signal based on a control signal from the controller 5, and applies the driving signal to each of the plurality of individual electrodes 12*d*. With this, the potential of each of the plurality of individual electrodes 12*d* is changed between a predetermined driving potential and the ground potential. In this situation, a part of the vibration plate 12*a* and a part of each of the plurality of piezoelectric bodies 12*c* (the parts being actuator 12*x*) which are sandwiched between one of the plurality of individual electrodes 12*d* and one of the plurality of pressure chambers 22 are deformed so as to project toward one of the plurality of pressure chambers 22. With this, the volume of one of the plurality of pressure chambers 21 is changed to thereby apply pressure to the ink in one of the plurality of pressure chambers 21, and causing the ink to be ejected or discharged from the nozzle 21. The actuator member 12 has a plurality of pieces of the actuator 12*x* each of which corresponds to one of the plurality of pressure chambers 22.

As described above, according to the present embodiment, the two outflow channels 25*x* and 25*y* are provided with respect to each of the nozzles 21 (see FIG. 3). Accordingly, in a case that the circulation of the ink is performed during the recording, the ink from the vicinity of the nozzle 21 is divided or dispersed toward to the two outflow channels 21*x* and 25*y*, thereby mitigating any bias in the flow of the ink. With this, it is possible to suppress the occurrence of the problem that the discharging direction (ejecting direction) of the ink from the nozzle 21 is deviated from the desired direction.

Further, in each of the individual channels 20, the orientation of the first vector V1 and the orientation of the second vector V2 have the component in the same orientation (see FIG. 3). In this case, the flow of the ink circulation is not inhibited, and the ink circulation can be performed smoothly. Consequently, any generation of the air bubbles can be suppressed.

The first vector V1 and the second vector V2 are parallel to each other (see FIG. 3). Namely, the orientation of the first vector V1 and the orientation of the second vector V2 are the same orientation. In a case that the first vector V1 and the second vector V2 are not parallel to each other, the fluid energy of the first vector V1 is dispersed or distributed into a component of the orientation of the second vector V2 and a component orthogonal to the orientation of the second vector V2, which in turn makes the fluid energy of the second vector V2 to be small. Due to this, the fluid energy cannot be transmitted efficiently, and the circulation of the ink cannot be performed smoothly. In view of this point, in the present embodiment, since the first vector V1 and the second vector V2 are parallel to each other, there is not any dispersion (distribution) of the fluid energy as described above, the fluid energy is transmitted efficiently, and the ink circulation can be performed smoothly. Consequently, it is possible to suppress any generation of the air bubbles in a more ensured manner Namely, the above can be summarized as follows: in a case that the first vector V1 and the second vector V2 are parallel to each other, the flow of the ink from the inflow channel 24 toward each of the outflow channels 25*x* and 25*y* is not hindered and thus makes it possible to perform the ink circulation smoothly, and consequently, it is possible to suppress the generation of air bubbles in a more ensured manner, as compared with a case that the first vector V1 and the second vector V2 are not parallel to each other.

The outflow channels 25*x* and 25*y* are within the area of the pressure chamber 22 in the paper width direction (third direction) (see FIG. 3). Namely, in the paper width direction (third direction), the two outflow channels 25*x* and 25*y* are positioned in a range occupied by the pressure chamber 22 in the third direction. In this case, it is possible to arrange the plurality of individual channels 20 highly densely in the paper width direction (third direction) (see FIG. 2). Consequently, it is possible to realize a small-sized head 1 in the paper width direction (third direction).

In the conveying direction (second direction), the return channel 32 is arranged between the connecting channels 23 of the first individual channel array 20A and the connecting channels 23 of the second individual channel array 20B; and the orientation of the vector V2 in each of the individual channels 20 of the first individual channel array 20A and the orientation of the vector V2 in each of the individual channels 20 of the second individual channel array 20B are opposite to each other (see FIG. 3). In this situation, a case is presumed wherein the other end 25*b* in the first individual channel array 20A and the other end 25*b* in the second individual channel array 20B overlap with each other in the conveying direction (second direction). In such a case, the pressure wave of the ink (liquid) flowing from each of the individual channels 20 in the first individual channel 20A into the return channel 32 and the pressure wave of the ink (liquid) flowing from each of the individual channels 20 in the second individual channel 20B into the return channel 32 interfere with each other, thereby leading to such a possibility that the discharge of the ink might become unstable. In view of this point, in the present embodiment, the other end 25*b* in the first individual channel array 20A and the other end 25*b* in the second individual channel array 20B do overlap with each other in the conveying direction (second direction). With this, it is possible to suppress any interference between the pressure wave of the ink from each of the individual channels 20 in the first individual channel array 20A and the pressure wave of the ink from each of the individual channels 20 in the second individual channel array 20B, thereby making it possible to improve the ejection (discharge) stability.

The one ends 25*a* of the two outflow channels 25*x* and 25*y* are arranged symmetrically with respect to the nozzle 21 (see FIG. 3). Namely, as seen from the vertical direction (first direction), the one end 25*a* of the outflow channel 25*x*, the nozzle 21, and the one end 25*a* of the outflow channel 25*y* are arranged on a same straight line (see FIG. 3). In this case, the flow of the ink in the vicinity of the nozzle 21 toward each of the outflow channels 25$x$ and 25$y$ is further dispersed or distributed, which in turn further mitigates any bias in the flow of the ink. This makes it possible to suppress the problem that the discharging direction (ejecting direction) of the ink from the nozzle 21 is deviated from the desired direction, in a more ensured manner.

The side surface of each of the supply channels 31A and 31B has a shape of the flat surface along the vertical direction (first direction) and the paper width direction (third direction) (see FIG. 2). In a case that there are any concavities and convexities in the side surface, the flow of the ink inside each of the supply channel 31A and 31B becomes to be not smooth, and any stagnation and/or any air bubbles might be generated. In view of this point, in the present embodiment, the side surface of each of the supply channels 31A and 31B has the shape of the flat surface along the paper width direction (third direction), and thus the flow of the ink inside each of the supply channels 31A and 31B is smooth, and any stagnation and/or any air bubbles are less likely to be generated.

Second Embodiment

Figure 5:
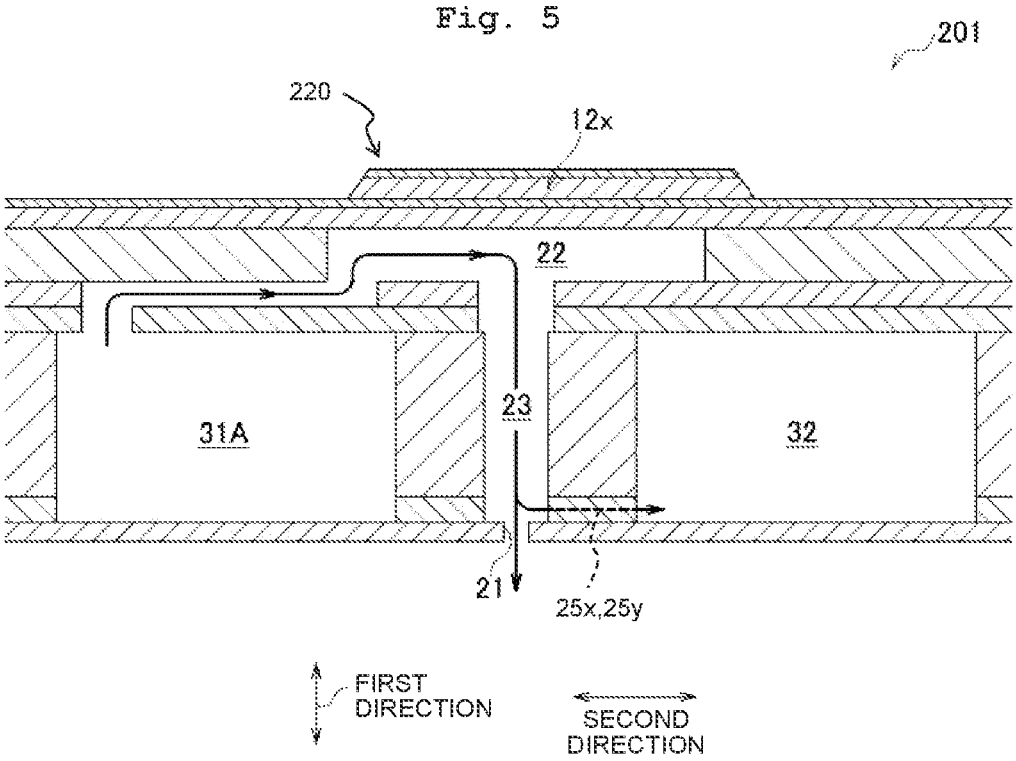
FIG. 5 is a cross-sectional view of a head according to a second embodiment of the present disclosure, corresponding to FIG. 4.

Next, an explanation will be given about a head 201 according to a second embodiment of the present disclosure, with reference to FIG. 5.

In the first embodiment (FIG. 4), the connecting channel 23 connects to the one end in the second direction of the pressure chambers 22. In contrast, in the second embodiment (FIG. 5), the connecting channel 23 connects to a central part (center) in the second direction of the pressure chamber 22, in each of individual channels 220 of the head 201. An amount of deformation of the actuator 12$x$ is the greatest at a part thereof corresponding to the central part in the second direction of the pressure chamber 22. In the second embodiment, by connecting the connecting channel 23 to this central part, a large pressure wave generated in the central part is efficiently transmitted to the nozzle 22 via the connecting channel 23, thereby making it possible to increase the discharge pressure.

Further, in the first embodiment (FIG. 4), although the other end in the second direction of the pressure chamber 22 overlaps, in the first direction, with the supply channel 31A or 31B corresponding thereto, the pressure chamber 22 does not overlap with the return channel 32 in the first direction. In contrast, in the second embodiment (FIG. 5), the other end in the second direction of the pressure chamber 22 overlaps, in the first direction, with the supply channel 31A or 31B corresponding thereto, and one end in the second direction of the pressure chamber 22 overlaps, in the first direction, with the return channel 32. Namely, at least a part of the return channel 32 overlaps with the pressure chamber 22 in the first direction. This configuration is realized by connecting the connecting channel 23 to the central part in the second direction of the pressure chamber 22, and is capable of realize a small-sized head 201 in the second direction (see FIGS. 4 and 5).

Third Embodiment

Figure 6:
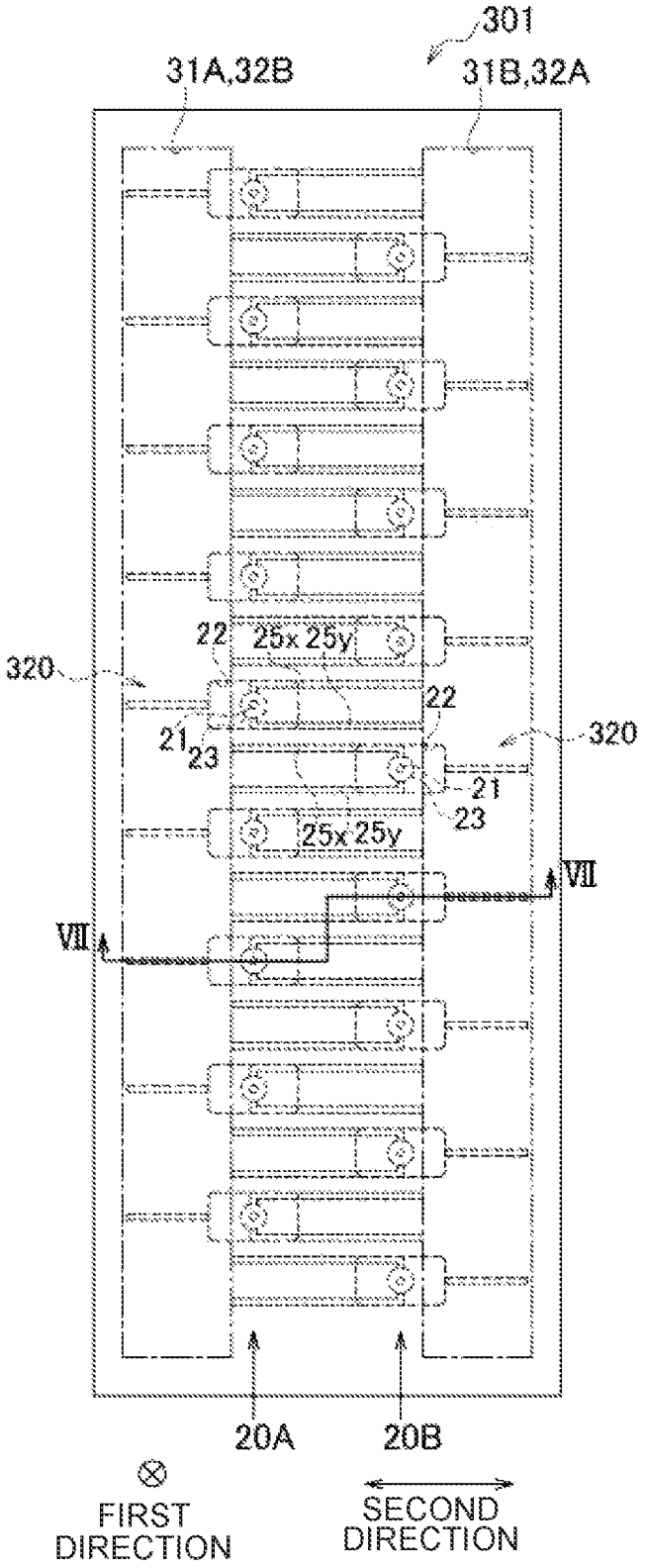
FIG. 6 is a plan view of a head according to a third embodiment of the present disclosure.
Figure 7:
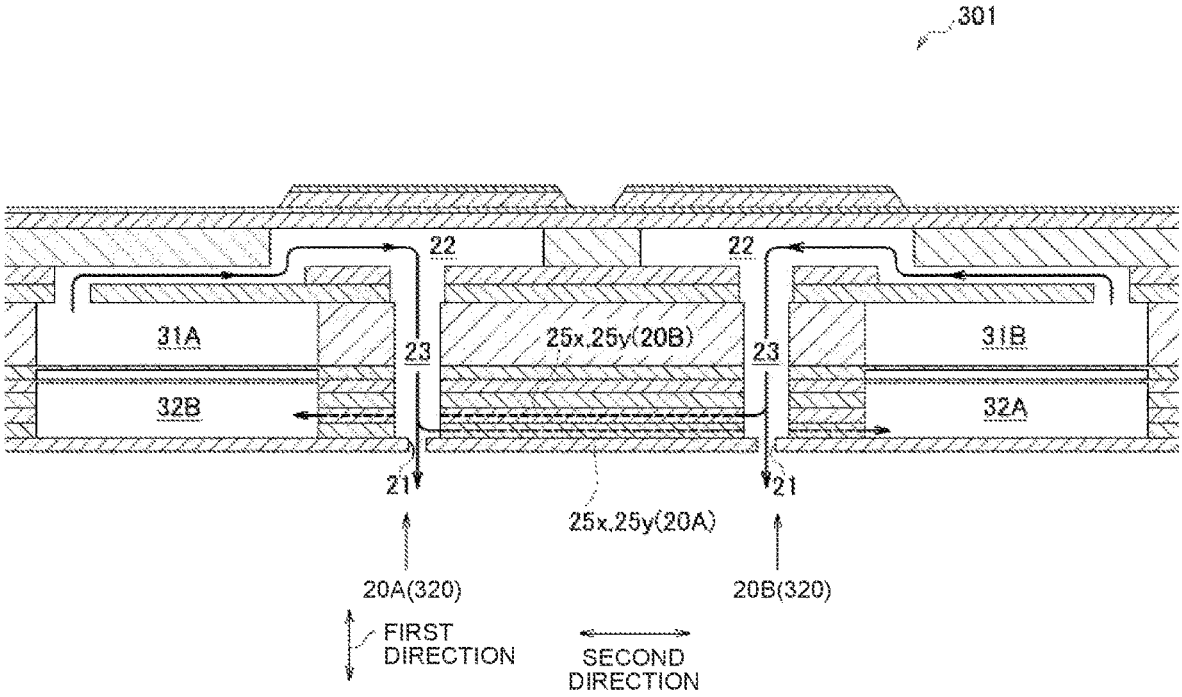
FIG. 7 is a cross-sectional view of the head along a line VII-VII in FIG. 6.

Next, an explanation will be given about a head 301 according to a third embodiment of the present disclosure, with reference to FIGS. 6 and 7.

In the first embodiment (FIG. 2), the supply channel 31A and the return channel 32 and the supply channel 31B are arranged side by side in the second direction. In the first embodiment, the supply channel 31A communicates with the individual channels 20 constructing the first individual channel array 20A, and the supply channel 31B communicates with the individual channels 20 constructing the second individual channel array 20B, and the return channel 32 communicates with both of the individual channels 20 constructing the first individual channel array 20A and the individual channels 20 constructing the second individual channel array 20B. In contrast, in the third embodiment (FIGS. 6 and 7), a supply channel 31A and a supply channel 32B are arranged side by side in the second direction, and a return channel 32A and a return channel 32B are arranged side by side in the second direction. In the third embodiment, the supply channel 31A communicates with individual channels 320 constructing a first individual channel array 20A, the supply channel 31B communicates with individual channels 320 constructing a second individual channel array 20B; and the return channel 32A communicates with the individual channels 320 constructing the first individual channel array 20A and the return channel 32B communicates with the individual channels 320 constructing the second individual channel array 20B. Note that the supply channel 31A corresponds to "one first common channel" of the present disclosure, and the supply channel 31B corresponds to "another first common channel" of the present disclosure; and return channel 32A corresponds to "one second common channel" of the present disclosure, and the return channel 32B corresponds to "another second common channel" of the present disclosure.

The supply channel 31A and the return channel 32B are arranged side by side in the first direction. The supply channel 31A is arranged at an upper side, and the return channel 32B is arranged at a lower side.

The supply channel 31B and the return channel 32A are arranged side by side in the first direction. The supply channel 31B is arranged at an upper side, and the return channel 32A is arranged at a lower side.

In the second direction, connecting channels 23 of the first individual channel arrays 20A and connecting channels 23 of the second individual channel array 20B are arranged between a set of the supply channel 31A and the return channel 32B, and a set of the supply channel 31B and the return channel 32A.

In the second direction, the connecting channels 23 of the second individual channel array 20B are arranged between the connecting channels 23 of the first individual channel array 20A and the return channel 32A. In the second direction, the connecting channels 23 of the first individual channel array 20A are arranged between the connecting channels 23 of the second individual channel array 20B and the return channel 32B.

Each of the connecting channels 23 is connected to a central part in the second direction of the pressure chamber 22, similarly to the second embodiment.

The outflow channels 25$x$ and 25$y$ in the first individual channel array 20A extend, in the second direction, from the connecting channel 23 of the first individual channel array 20A up to the return channel 32A, beyond the connecting channel 23 of the second individual channel array 20B.

The outflow channels 25$x$ and 25$y$ of the second individual channel array 20B extend, in the second direction, from the connecting channel 23 in the second individual channel array 20B up to the return channel 32B, beyond the connecting channel 23 of the first individual channel array 20A.

A direction in which the outflow channels 25$x$ and 25$y$ of the first individual channel array 20A extend from the connecting channel 23 of the first individual channel array 20A and a direction in which outflow channels 25x and 25y of the second individual channel array 20B extend from the connecting channel 23 of the second individual channel array 20B are mutually opposite to each other. Note that the outflow channels 25x and 25y of the second individual channel array 20B are located to be above the outflow channels 25x and 25y of the first individual channel array 20A.

As described above, the head 301 according to the third embodiment has the two individual channel arrays 20A and 20B, and the supply channels 31A and 31B and the return channels 32A and 32B corresponding to the first and second individual channel arrays 20A and 20B, respectively. The supply channel 31A overlaps with the return channel 32B in the first direction, and the supply channel 31B overlaps with the return channel 32A in the first direction. Further, a range occupied by the outflow channels 25x and 25y of the first individual channel array 20A in the second direction overlaps with a range occupied by the outflow channels 20A and 20B of the second individual channel array 20B in the second direction. By such an arrangement, it is possible to realize a small-sized head 301 in the second direction.

Fourth Embodiment

Figure 8:
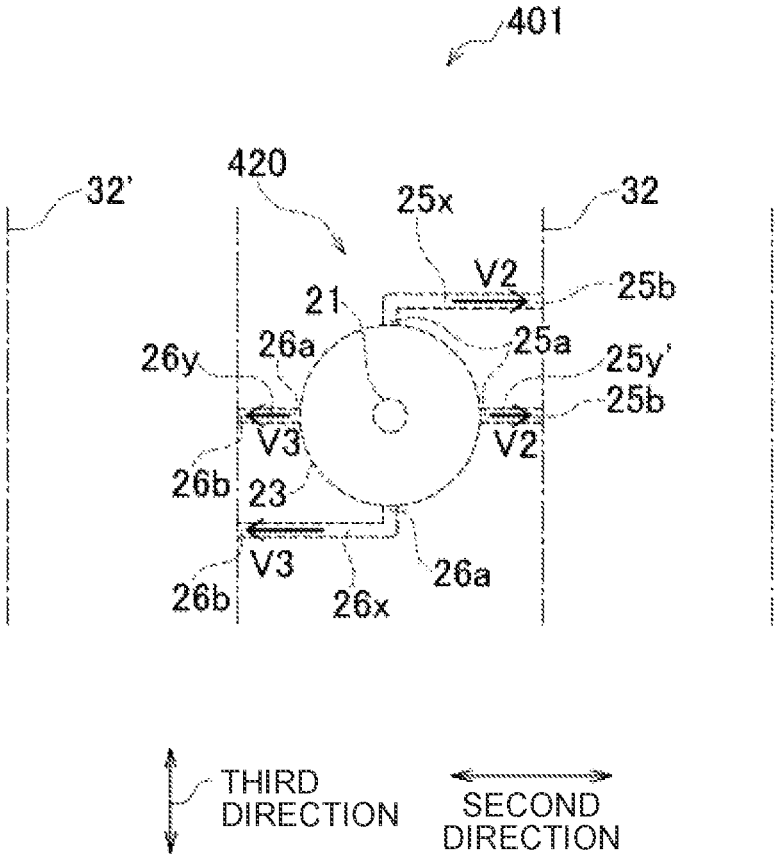
FIG. 8 is a plan view depicting a communicating relationship between a connecting channel of one piece of an individual channel and a return channel in a head according to a fourth embodiment of the present disclosure.

Next, an explanation will be given about a head 401 according to a fourth embodiment of the present disclosure, with reference to FIG. 8.

In the first embodiment (FIG. 3), the two outflow channels 25x and 25y are provided on each of the nozzles 21. In contrast, in the fourth embodiment (FIG. 8), four outflow channels 25x, 25y', 26x and 26y are provided on each of the nozzles 21. Among the four outflow channels 25x, 25y', 26x and 26y, each of the outflow channels 25x and 25y' corresponds to a "second communicating channel" of the present disclosure, and each of the outflow channels 26x and 26y corresponds to a "third communicating channel" of the present disclosure.

In the fourth embodiment, two return channels 32 and 32' are provided on each of individual channels 420. The connecting channel 23 is arranged, in the second direction, between the return channel 32 and the return channel 32'. The outflow channels 25x and 25y' communicate with the return channel 32. The outflow channels 26x and 26y communicate with the return channel 32'.

Each of the return channels 25x and 25y' has one end 25a communicating with the connecting channel 23, and the other end 25b communicating with the return channel 32. The one end 25a connects to a side surface of the connecting channel 23. The other end 25b connects to a side surface of the return channel 32.

Each of the return channels 26x and 26y has one end 26a communicating with the connecting channel 23, and the other end 26b communicating with the return channel 32'. The one end 26a connects to the side surface of the connecting channel 23. The other end 26b connects to a side surface of the return channel 32'.

The four outflow channels 25x, 25y', 26x and 26y extend radially from the connecting channel 23.

The four outflow channels 25x, 25y', 26x and 26y are parallel to one another, and each extend in the second direction. Note that strictly speaking, the outflow channels 25x and 26x have a shape of the letter "L"; parts thereof in the vicinity of the one end 25a and the one end 26a, respectively, extend in the third direction. However, the lengths of these parts are minute with respect to the respective entireties of the outflow channels 25x and 26x. Thus, the influences of these parts on the flows of the ink in the outflow channels 25x and 26x, respectively, are small.

Second vector V2 of the respective outflow channels 25x and 25y' have orientation, the orientation being from the one end 25a toward the other end 25b in the extending direction of the outflow channels 25x and 25y'. Third vector V3 of the respective outflow channels 26x and 26y have orientation, the orientation being from the one end 26a toward the other end 26b in the extending direction of the outflow channels 26x and 26y. Here, the extending direction of each of the outflow channels 25x, 25y', 26x and 26y is an extending direction of a part which is linear and longest in each of the outflow channels. The second vector V2 of the outflow channels 25x and 25y' and the third vector V3 of the outflow channels 26x and 26y are parallel to one another, and are directions which are opposite to one another.

The one end 25a of the outflow channel 25x is on one side in the third direction with respect to the nozzle 21, and the one end 26a of the outflow channel 26x is on the other side in the third direction with respect to the nozzle 21. Namely, in the third direction, the nozzle 21 is located between the one end 25a of the outflow channel 25x and the one end 26a of the outflow channel 26x. The one end 25a of the outflow channel 25x, the nozzle 21 and the one end 26a of the outflow channel 26a are arranged on a straight line extending in the third direction. The one end 25a of the outflow channel 25y' is on one side in the second direction with respect to the nozzle 21, and the one end 26a of the outflow channel 26y is on the other side in the second direction with respect to the nozzle 21. Namely, in the second direction, the nozzle 21 is located between the one end 25a of the outflow channel 25y' and the one end 26a of the outflow channel 26y. The one end 25a of the outflow channel 25y', the nozzle 21 and the one end 26a of the outflow channel 26y are arranged on a straight line extending in the second direction. The one ends 25a and 26a of the four outflow channels 25x, 25y', 26x and 26y are arranged symmetrically with respect to the nozzle 21.

As described above, according to the fourth embodiment, the one ends 25a of the two outflow channels 25x and 25y' and the one ends 26a of the two outflow channels 26x and 26y are arranged symmetrically with respect to the nozzle 21. In this case, the flow of the ink in the vicinity of the nozzle 21 is more dispersed (distributed), and any bias in the flow of the ink is further mitigated. With this, it is possible to suppress the problem that the discharging direction (ejecting direction) is deviated from the desired direction, in a more ensured manner.

Modification

Although the embodiments of the present disclosure have been described above, the present disclosure is not limited to or restricted by the above-described embodiments, and various design changes can be made within the scope of the claims.

The number of the second communicating channel is not limited to 2 (two), and may be 3 (three) or more.

The second communicating channel may have a part which is outside the area of the pressure chamber in the third direction (a part not overlapping with the pressure chamber).

The first vector V1 from the one end 24a toward the other end 24b of the inflow channel 24 and the second vector V2 which is from the one end 25a toward the other end 25b of one of the outflow channels 25x and 25y are not limited to being parallel to one another (see FIG. 3). For example, it is allowable that each of the outflow channels 25x and 25y extends in a direction crossing with respect to both of the second direction and the third direction, and that the second vector V2 has components in the second and third directions, respectively.

In the first embodiment (FIG. 2), there is provided one return channel 32 communicating with the plurality of individual channels 20 constructing the two individual channel arrays 20A and 20B; it is allowable, however, to provide, individually, a return channel 32 communicating with the individual channels 20 constructing the first individual channel array 20A, and a return channel 32 communicating with the individual channels 20 constructing the second individual channel array 20B.

In the above-described embodiments, although one pressure chamber is provided with respect to one nozzle, it is allowable that two or more pieces of the pressure chamber are provided with respect to one nozzle. Alternatively, in the above-described embodiments, although one nozzle is provided with respect to one pressure chamber, it is allowable that two or more pieces of the nozzle are provided with respect to one pressure chamber.

The head is not limited to being of the line-system, and may be of a serial system in which the liquid is ejected or discharged from the nozzles to a discharge object while the head is moving in a scanning direction parallel to the paper width direction.

In the above-described embodiments, although the piezoelectric body 12*c* is provided on each of the pressure chambers 22, the present disclosure is not limited to this. It is allowable that the piezoelectric body 12*c* is provided so as to cover all the pressure chambers 22 which are opened in the upper surface of the plate 11*a*, similarly to the vibration plate 12*a* and the common electrode 12*b*. Further, although the actuator is of the piezoelectric system in the above-described embodiments, the present disclosure is not limited to this; it is allowable that the actuator is of another system (for example, a thermal system using a heating element, an electrostatic system using the electrostatic force, etc.).

The discharge object is not limited to paper (paper sheet) and may be, for example, a recording medium such as cloth (fabric), a substrate, etc.

The liquid discharged or ejected from the nozzles is not limited to the ink, and may be an arbitrary liquid (e.g., a treating liquid, etc., which causes a component in the ink to aggregate or precipitate).

The present disclosure is not limited to the printer, and is also applicable to a facsimile machine, a copying machine, a multi-functional peripheral, etc. The present disclosure is also applicable to a liquid discharging apparatus used for an application different from the recording of an image (for example, a liquid discharging apparatus which discharges or ejects a conductive liquid onto a substrate to thereby form a conductive pattern on the substrate).

Note that the all the above-described embodiments and modifications may be combined with each other, unless mutually exclusive with one another.

What is claimed is:

1. A liquid discharging head comprising:

a plurality of individual channels;

at least one first common channel communicating with the plurality of individual channels; and at least one second common channel communicating with the plurality of individual channels, wherein each of the plurality of individual channels includes:

a pressure chamber, a nozzle which is apart from the pressure chamber in a first direction, a connecting channel connecting the pressure chamber and the nozzle, a first communicating channel which has one end connected to the at least one first common channel and the other end connected to the pressure chamber, and two second communicating channels each of which has one end connected to the connecting channel and the other end connected to the at least one second common channel, and which are parallel to each other;

in each of the plurality of individual channels, a first vector has an orientation from the one end to the other end of the first communicating channel along an extending direction of the first communicating channel;

a second vector has an orientation from the one end to the other end of each of the two second communicating channels along an extending direction of the two second communicating channels;

the first communicating channel is arranged, with respect to the nozzle, on one side in a second direction orthogonal to the first direction, and the two second communicating channels are arranged, with respect to the nozzle, on the other side in the second direction; and each of the orientation of the first vector and the orientation of the second vector includes an orientation component from the one side toward the other side in the second direction.

2. The liquid discharging head according to claim 1, wherein the first vector and the second vector are parallel to each other.

3. The liquid discharging head according to claim 2, wherein the orientation of the first vector and the orientation of the second vector are same as each other.

4. The liquid discharging head according to claim 3, wherein the orientation of the first vector and the orientation of the second vector are an orientation from the one side toward the other side in the second direction.

5. The liquid discharging head according to claim 1, wherein in a third direction which is orthogonal to the first direction and the second direction, the two second communicating channels range within a range in the third direction occupied by the pressure chamber.

6. The liquid discharging head according to claim 1, wherein the connecting channel is connected to a center in the second direction of the pressure chamber.

7. The liquid discharging head according to claim 6, wherein at least a part of the at least one second common channel overlaps with the pressure chamber in the first direction.

8. The liquid discharging head according to claim 7, wherein at least a part of the at least one first common channel overlaps with the pressure chamber in the first direction.

9. The liquid discharging head according to claim 1, wherein the plurality of individual channels are aligned in a third direction orthogonal to the first direction and the second direction, and construct a first individual channel array and a second individual channel array, the first individual channel array and the second individual channel array being arranged side by side in the second direction;

the at least one second common channel is arranged, in the second direction, between the connecting channel belonging to the first individual channel array and the connecting channel belonging to the second individual channel array;

the orientation of the second vector in the first individual channel array and the orientation of the second vector in the second individual channel array are opposite to one another; and the other ends of the two second communicating channels in the first individual channel array and the other ends of the two second communicating channels in the second individual channel array do not overlap with one another in the second direction.

10. The liquid discharging head according to claim 1, wherein the plurality of individual channels are aligned in a third direction orthogonal to the first direction and the second direction, and construct a first individual channel array and a second individual channel array, the first individual channel array and the second individual channel array being arranged side by side in the second direction;

the at least one second common channel includes:

one second common channel communicating with the individual channels constructing the first individual channel array, and another second common channel communicating with the individual channels constructing the second individual channel array;

the connecting channel belonging to the second individual channel array is arranged, in the second direction, between the connecting channel belonging to the first individual channel array and the one second common channel, the connecting channel belonging to the first individual channel array is arranged, in the second direction, between the connecting channel belonging to the second individual channel array and the another second common channel.

11. The liquid discharging head according to claim 10, wherein the two second communicating channels belonging to the first individual channel array extend, in the second direction, from the connecting channel belonging to the first individual channel array up to the one second common channel, beyond the connecting channel belonging to the second individual channel array; and the two second communicating channels belonging to the second individual channel array extend, in the second direction, from the connecting channel belonging to the second individual channel array up to the another second common channel, beyond the connecting channel belonging to the first individual channel array.

12. The liquid discharging head according to claim 10, wherein in the first individual channel array, the connecting channel is connected to a center in the second direction of the pressure chamber; and in the second individual channel array, the connecting channel is connected to a center in the second direction of the pressure chamber.

13. The liquid discharging head according to claim 10, wherein the at least one first common channel includes:

one first common channel communicating with the individual channels constructing the first individual channel array, and another first common channel communicating with the individual channels constructing the second individual channel array;

the one first common channel overlaps with the another second common channel in the first direction; and the another first common channel overlaps with the one second common channel in the first direction.

14. The liquid discharging head according to claim 1, wherein the one ends of the two communicating channels are arranged symmetrically with respect to the nozzle.

15. The liquid discharging head according to claim 1, wherein each of the plurality of individual channels further includes two third communicating channels each of which has one end connected to the connecting channel and the other end connected to the at least one second common channel; and the one ends of the two second communicating channels and the one ends of the two third communicating channels are arranged symmetrically with respect to the nozzle.

16. The liquid discharging head according to claim 15, wherein the at least one second common channel has:

one second common channel to which the two second communicating channels are connected, and another second common channel to which the two third communicating channels are connected; and in the second direction, the connecting channel is arranged between the one second common channel and the another second common channel.

17. The liquid discharging head according to claim 1, wherein the plurality of individual channels are aligned in a third direction orthogonal to the first direction and the second direction; and each of the at least one first common channel and the at least one second common channel extends in the third direction; and a side surface of the at least one first common channel is a flat surface along the first direction and the third direction.

* * * * *